US005163591A

United States Patent [19]

Leiserson et al.

[11] Patent Number: 5,163,591

[45] Date of Patent: Nov. 17, 1992

[54] PAINT BUCKET HOLSTER

[76] Inventors: Steven G. Leiserson; Peter W. Hardy, both of 10845 Wheatlands Ave., Santee, Calif. 92071

[21] Appl. No.: 719,971

[22] Filed: Jun. 24, 1991

[51] Int. Cl.[5] ..... A45F 5/00

[52] U.S. Cl. ..... 224/148; 224/197; 224/252; 224/226; 224/223; 224/250; 224/907; 224/901; 224/151

[58] Field of Search ..... 224/148, 224, 197, 198, 224/199, 200, 225, 226, 223, 253, 252, 250, 907, 901, 151

[56] References Cited

U.S. PATENT DOCUMENTS

| | | | |
|---|---|---|---|
| 3,268,130 | 8/1966 | Simpson | 224/198 |
| 4,325,503 | 4/1982 | Swinney | 224/148 |
| 4,420,104 | 12/1983 | DiIenno | 224/250 |
| 5,004,136 | 4/1991 | Leath | 224/226 |
| 5,016,791 | 5/1991 | Burow | 224/148 |
| 5,067,643 | 11/1991 | McKinney | 224/224 |

*Primary Examiner*—Linda J. Sholl

*Attorney, Agent, or Firm*—Henri J. A. Charmasson

[57] ABSTRACT

A holster to be used by a painter or to suspend a container from his waist has an oblong panel which is suspended from its midsection to the outer face of the belt by a hook-and-ring assembly so that the upper end of the panel is engaged between the belt and the waist of the wearer. The opposite end of the panel has a strap assembly which adjustably surrounds and supports the container. A pair of looping straps secured to the upper and lower edges of the belt at opposite sides of the panel attachment points are use to slidingly engage the arcuate handle of the container. Due to the swinging attachment of the panel to the belt, the holster can be used to carry the container on either the right or left side. During bending or stooping movements the panel automatically adjusts to maintain a vertical position for the container, the friction of the upper end of the panel against the inner face of the belt and the waist of the wearer limits and dampens the oscillation of the container and panel.

8 Claims, 1 Drawing Sheet

PAINT BUCKET HOLSTER

FIELD OF THE INVENTION

This invention relates to tool belts, baldrics, and more specifically to trademens' personal supports for nail and paint buckets.

BACKGROUND OF THE INVENTION

The prior art offers various examples of devices available to tradesmen for suspending paint or nail buckets from their waists so as to leave their hands free as they move about their work stooping, bending over to reach awkward locations, and climbing ladders. In order to avoid spilling, the bucket suspension device must be able to swing back and forth about the waist of the wearer, as well as sideways. Those requirements have led to the design of bulky, complex and heavy apparatuses as disclosed in U.S. Pat. Nos. 4,325,503 and 4,527,720. These prior art devices are so cumbersome that they often interfere with the free movement of the tradesmen that wear them. Furthermore, their rotating bucket suspensions are so loose as to be very unstable, and cause uncontrollable oscillations of the container. There is a need for a simpler, lighter and more comfortable type of paint bucket holster which retains the flexibility of the devices of the prior art, and avoid undue oscillations of the suspended container.

SUMMARY OF THE INVENTION

The principal and secondary objects of this invention are to provide a holster to be used by a tradesman to suspend a paint or nail bucket from his waist on either the right or the left side; and to keep the bucket in an upright position during various bending and stooping movements of the tradesman, without interfering with his freedom of movement, while avoiding sudden and excessive oscillating movements of the container.

These and other objects are achieved by the combination of a comfortable belt and an oblong panel which is suspended from a midsection of the outer face of the belt by a hook-and-ring assembly so that the upper end of the panel is engaged between the belt and the waist of the wearer. The opposite end of the panel has a strap assembly which adjustably surrounds and supports the container. A pair of locking straps secured to the upper and lower edges of the belt at opposite sides of the panel attachment points, are used to slidingly engage the arcuate handle of the container. Due to the swinging attachment of the panel to the belt, the holster can be used to carry the container on either the right or left side. During bending or stooping movements the panel automatically adjusts to maintain a vertical position for the container, the friction of the upper end of the panel against the inner face of the belt and the waist of the wearer limits and dampens the movements of the container and panel.

DESCRIPTION OF THE PREFERRED EMBODIMENT OF THE INVENTION

Figure 1:
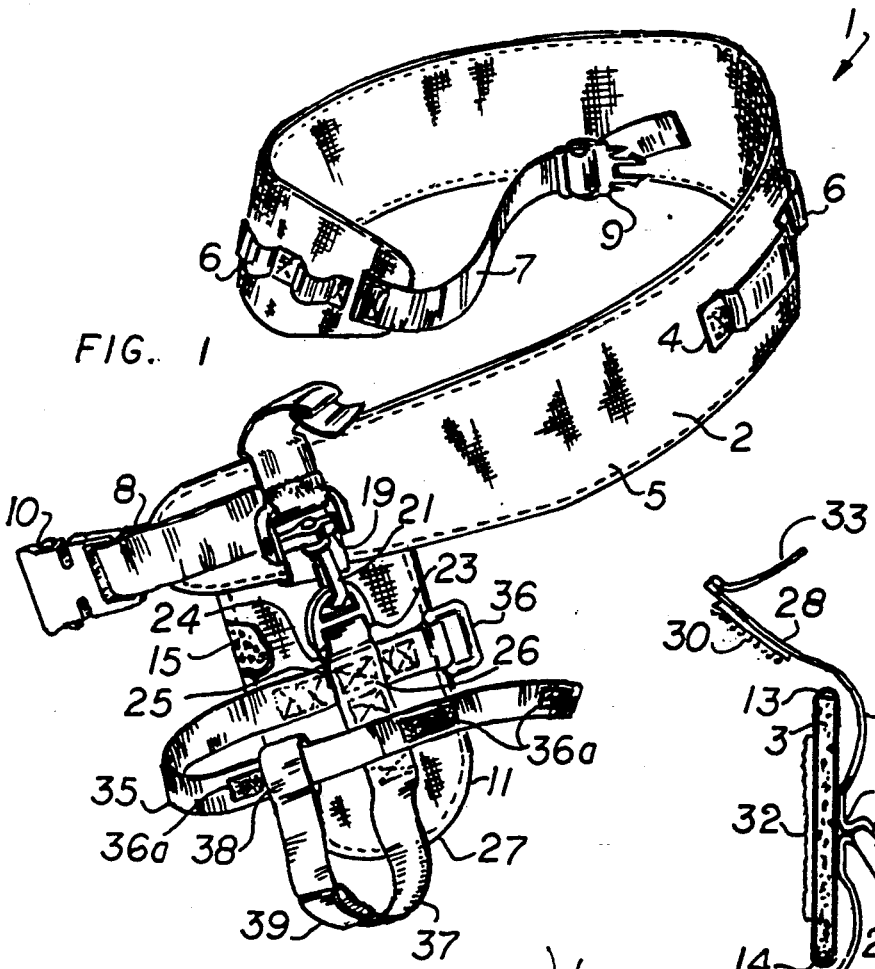
FIG. 1 is a perspective view of a nail or paint bucket holster embodying the invention.
Figure 2:
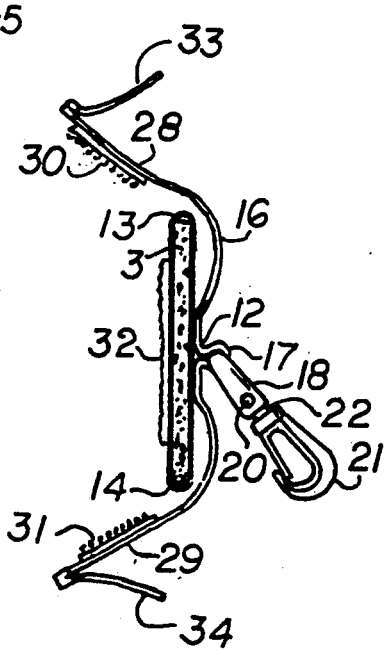
FIG. 2 is a cross-sectional view of the suspension assembly.

Referring now to the drawing, there is shown a holster 1 which comprises a wide belt 2 made of durable fabric surrounding a slab 3 of synthetic foam that provides comfort to the wearer and a certain degree of vertical rigidity to the belt. A narrow web 4 of woven nylon or other wear resistant fabric is stitched at various points along the outer face 5 of the belt, forming a series of holding loops 6 for suspending tools and other working implements. Two wider webs 7, 8 secured to opposite ends of the belt are equipped with adjustable buckle elements, 9, 10. An oblong panel 11 is swingingly and swivelly suspended from a side of the belt at a point 12 on the outer face 5 of the belt generally half-way between the upper edge 13 and lower edge 14 of the belt via a suspension assembly discussed below. The panel is made from the same fabric material as the belt including an internal slab 15 of synthetic foam which gives it with a certain degree of rigidity. A part of the panel suspension assembly associated with the belt comprises a web 16 vertically stitched to the outer face 5 of the belt to form a loop 17 into which is engaged a D-ring 18. A yoke 19 is rotatively mounted across the open end of the D-ring through bores 20. A closable hook 21 has a shank 22 rotatively retained in a bore in the center of the yoke 19.

A second part of the suspension assembly associated with the panel 11 comprises a ring 23 engaged by the hook 21, and captured by a loop 24 at the end of a strap 25 which is stitched to the very center 26 of the panel. It should be noticed that once the hook 21 is engaged into the ring 23, the distance from the center 26 of the panel and the nearest, i.e., the lower, edge of the belt is substantially less than the distance between the center of the panel 26 and either one of the short edges 27 of the panel 11.

The web 16 extends symmetrically upward and downward beyond the upper and lower edges 13, 14 of the belt to form two securing straps 28, 29. Underneath each of these straps is a patch 30, 31 of hooks-and-vanes fasteners which cooperates with a patch 32 of loop material stitched to the inner face of the belt behind the suspension point 12. The respective extremities 33, 34 of the securing webs 28 29 are stitched in a fold-back position to provide convenient pull-tabs. A first holding strap 35 is stitched horizontally across the width of the panel from its central point 26 to form a bucket-holding loop which can be adjusted around the bucket by means of a ring 36 and cooperating patches of hooks-and-vanes fasteners **36*a*. A second bucket-holding strap 37 is stitched to the panel, and extends vertically from the panel central point 26 in a direction opposite to the suspending ring 23, and terminates in a loop 38 which can be engaged by the free end of the first holding strap 35. A second loop 39 along the second strap 37** may be used to secure smaller buckets.

Figure 3:
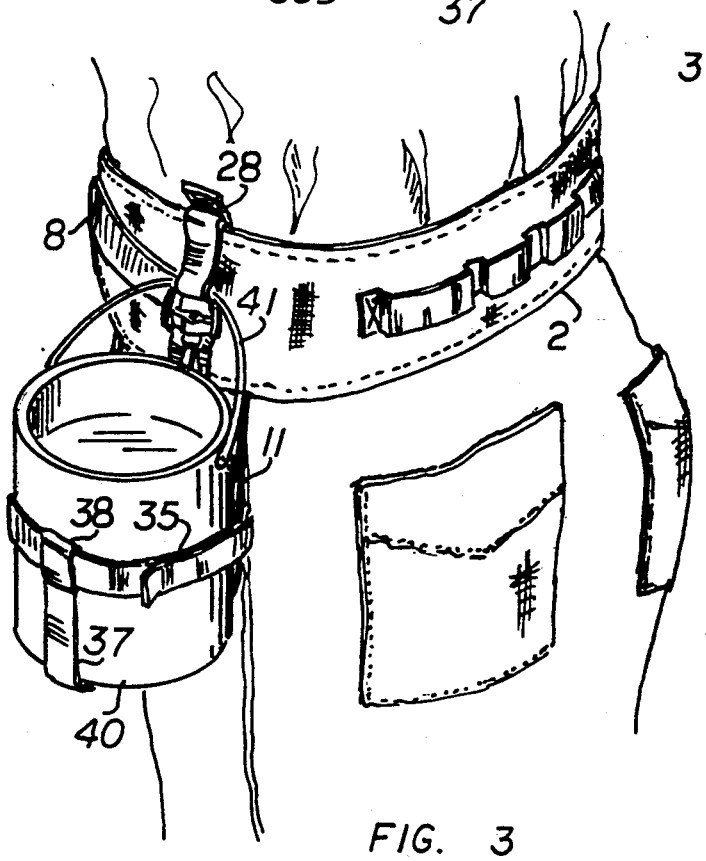
FIG. 3 is a perspective view of the holster shown in combination with a paint bucket.

As illustrated in FIG. 3, a bucket 40 can be safely mounted against the panel 11 by means of the securing straps 35, 37, while its arcuate handle 41 is loosely and slidingly captured by the upper handle-securing web 28. The upper narrow end of the panel extends behind the belt 2. As the wearer leans forward or backward, stoops or makes any other movement, the bucket suspension assembly lets the bucket and panel swing and rotate to maintain a substantial vertical position, since the center of gravity of the bucket is located far below the suspension point on the belt. The movement of the back panel 11 and bucket 40 is only restrained by the friction of the upper end of the panel against the inner face of the belt and the waist of the wearer. That friction stabilizes the panel against unwanted oscillation and slows or dampens the swinging rotating movement of the panel in relation to the belt during leaning, stooping and bending movements of the wearer.

Figure 4:
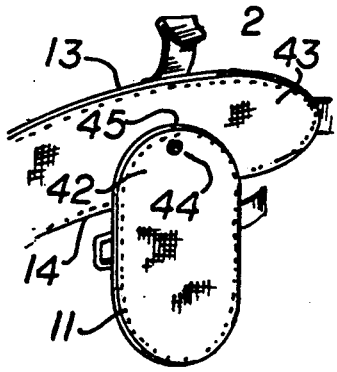
FIG. 4 is a partial perspective view of an alternate suspension arrangement of the container panel.

The upper narrow end 42 of the panel 11 may alternately be rotatively suspended against the inner face 43 of the belt 2 by a grommet 44 as illustrated in FIG. 4. The grommet is preferably located half-way between the upper edge 13 and lower edge 14 of the belt, and passes through a first aperture in the belt and a second aperture near the shorter edge 45 of the panel. While this panel suspension arrangement does not provide the same range of movement as the previously-described one, its retains the oscillation dampening function.

Since, in both suspension arrangements, the panel 11 can be swung over either edge of the belt 2, and the belt itself is symmetrically constructed, the bucket-holding assembly can be hung from either the right or left side of the wearer's waist.

While the preferred embodiment of the invention has been described, modifications can be made and other embodiments may be devised without departing from the spirit of the invention and the scope of the appended claims.

What is claimed is:

1. A holster for suspending a container from the waist of a tradesman which comprises:

a flat belt having an inner face, an outer face, an upper edge and a lower edge;

an oblong panel having a front face, a back face, two long edges and two short edges;

means for swingingly and swivellingly suspending the panel from a outer face section of the belt, said means for suspending comprising:

an anchor point in a central area on the front face of the panel, a suspension point substantially half-way between the upper edge and the lower edge of said outer face section of the belt, a first loop-forming link attached to said anchor point, and a second loop-forming link attached to said suspension point and engaging said first loop-forming link whereby said second loop-forming link engaging said first loop-forming link allows swinging and swiveling movements of said first link and panel in relation to said second link and belt; and said means for suspending being sized and located so that the distance between said anchor point and said lower edge is lesser than the distance between said anchor point and one of said short edges, whereby said short edge can be tucked under the belt when worn by said tradesman; and a strap assembly attached to a location on the panel opposite said lower edge in relation to said anchor point, said strap assembly being shaped and dimensioned to adjustably hold the container.

2. The holster of claim 1 which further comprises means on the belt for slidingly engaging an arcuate handle of the container.

3. The holster of claim 1, wherein one of said links is a hook having a shank swivelly connected to a retaining member.

4. The holster of claim 2, wherein said means for slidingly engaging comprise a pair of straps secured to the upper and lower edges of the belt at opposite sides of said section.

5. The holster of claim 4, wherein each of said straps comprise a means for adjustably looping the strap around the handle.

6. The holster of claim 1, wherein said section is equidistant from the upper and lower edges of the belt.

7. The holster of claim 1, wherein said strap assembly comprises:

a first web extending from said location on the panel under said container;

a first closed loop formed at a distal section of said first web;

a second web extending from said location around the container and engaging said closed loop; and means for adjustably securing a distal portion of the second web to the panel.

8. The holster of claim 7, wherein said strap assembly further comprises a second closed loop formed at said distal section of the first web, said second closed loop being spread apart from said first closed loop.

* * * * *